US009415839B2

(12) United States Patent
Todd

(10) Patent No.: US 9,415,839 B2
(45) Date of Patent: Aug. 16, 2016

(54) NAUTICAL RAILING

(71) Applicant: Jeremy Todd, Gonzales, LA (US)

(72) Inventor: Jeremy Todd, Gonzales, LA (US)

( * ) Notice: Subject to any disclaimer, the term of this patent is extended or adjusted under 35 U.S.C. 154(b) by 0 days.

(21) Appl. No.: 14/640,916

(22) Filed: Mar. 6, 2015

(65) Prior Publication Data

US 2016/0101830 A1 Apr. 14, 2016

Related U.S. Application Data

(63) Continuation-in-part of application No. 14/510,291, filed on Oct. 9, 2014.

(51) Int. Cl.
*B63B 17/04* (2006.01)
*B63B 21/04* (2006.01)

(52) U.S. Cl.
CPC ..... *B63B 17/04* (2013.01); *B63B 21/045* (2013.01)

(58) Field of Classification Search
CPC ..... B63B 17/00; B63B 17/02; B63B 17/04; B63B 21/045; B63B 45/00; B63B 45/02; B63B 7/00; B63B 7/08; B63B 7/085; B63B 35/00; B63B 21/04; B63B 25/28
USPC ..... 114/218, 364
See application file for complete search history.

(56) References Cited

U.S. PATENT DOCUMENTS

| | | | | |
|---|---|---|---|---|
| 820,974 | A | 5/1906 | Hilpert | |
| 1,291,341 | A | 1/1919 | Young | |
| 2,315,516 | A | 4/1943 | Gray | |
| 3,193,228 | A | 7/1965 | Chion | |
| 5,243,928 | A * | 9/1993 | Brenaman | B63B 25/28 114/364 |
| 6,155,191 | A | 12/2000 | Weaver | |
| 6,279,880 | B1 | 8/2001 | Hawks, Jr. | |
| 7,093,550 | B2 | 8/2006 | Williamson | |
| 7,475,868 | B1 | 1/2009 | Gibbs | |
| 7,896,132 | B2 | 3/2011 | O'Gorman | |
| 8,544,401 | B2 * | 10/2013 | Arote | E02B 3/24 114/218 |
| 2011/0094828 | A1 | 4/2011 | Duvekot et al. | |
| 2013/0087087 | A1 | 4/2013 | Werbel | |

OTHER PUBLICATIONS

Webpage: Fall Protection, Construction Safety and Health Outreach Program produced by the U.S. Department of Labor OSHA Office of Training and Education and dated May 1996; https://www.osha.gov/doc/outreachtraining/htmlfiles/subpartm.html captured Sep. 11, 2014.

Feb. 12, 2016 International Search Report and Written Opinion for PCT/US2015/054840 which is related to the present application.

* cited by examiner

*Primary Examiner* — Lars A Olson
(74) *Attorney, Agent, or Firm* — John B. Edel; Edel Patents LLC

(57) ABSTRACT

Fall protection structures are disclosed relating to nautical vessels that include a deck with a kevel and timberhead positioned on the deck, a post mechanically attached to the kevel and rising above the deck having middle and upper attachment points on the post, another post mechanically attached to the timberhead and rising above the deck having middle and upper attachment points, a rail connecting the middle attachment points, and another rail connecting the upper attachment points.

13 Claims, 8 Drawing Sheets

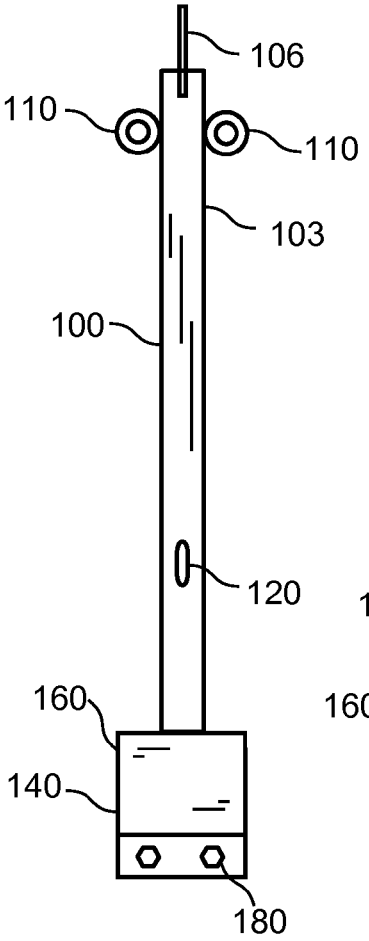
Fig. 1
Fig. 2
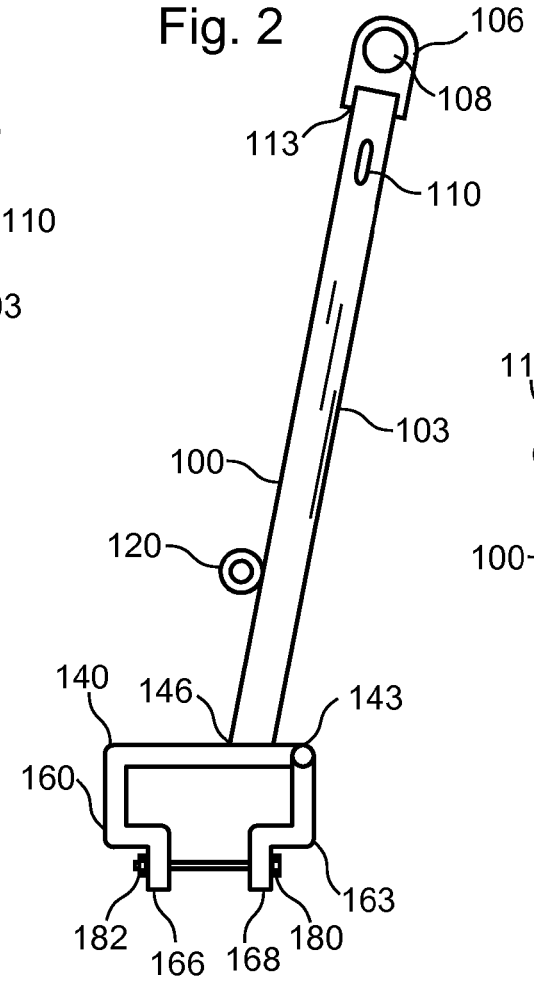
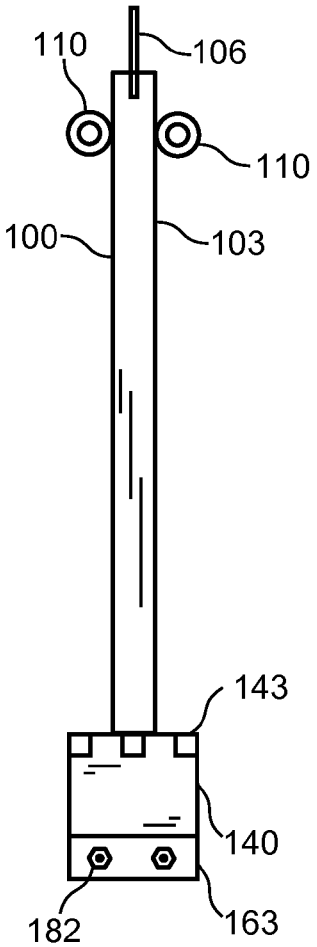
Fig. 3

NAUTICAL RAILING

This application is a Continuation-In-Part of application Ser. No. 14/510,291, entitled Nautical Railing, filed Oct. 9, 2014.

Railings and railing systems described herein may be used in fall protection. Certain railings disclosed herein may provide an easily installed railing system for use on nautical vessels such as barges.

BRIEF DESCRIPTION OF THE DRAWINGS

FIG. 1 shows a front view of a kevel post assembly.

FIG. 2 shows a side view of a kevel post assembly.

FIG. 3 shows a rear view of a kevel post assembly.

DETAILED DESCRIPTION

Example 1

Figure 4:
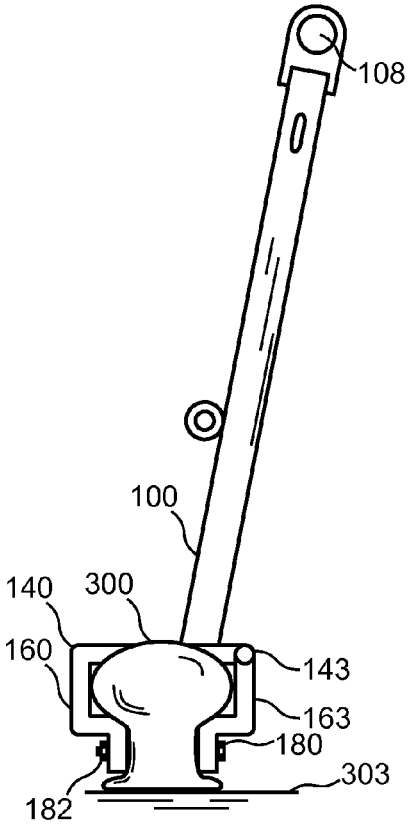
FIG. 4 shows a side view of a kevel post assembly attached to a kevel.

Referring now to FIG. 1, FIG. 2, and FIG. 3 of the drawings, Kevel post assembly 100 may for example comprise Rail post 103, Primary top rail eyelet 106, Primary top rail eyelet opening 108, Secondary top rail eyelet 110, Middle rail eyelet 120, and Kevel clasp 140. Kevel clasp 140 may for example comprise Kevel clasp hinge 143, Post clasp connection point 146, Clasp base 160, Clasp hinge arm 163, Clasp base lower extent 166, Clasp hinge arm lower extent 168, Bolts 180, and Nuts 182. The connection between Rail post 103 and Kevel clasp 140 may be a welded connection and Rail post 103 may extend either vertically from Kevel clasp 140 or Rail post 103 may extend from Kevel clasp 140 at an angle which deviates from vertical as shown in FIG. 2. Kevel clasp hinge 143 serves to allow Kevel clasp 140 to open in such a way that Kevel clasp 140 may grasp a kevel (not shown). Bolts 180 and Nuts 182 act to securely fastened Kevel clasp 140 around the center of a kevel (not shown). Middle rail eyelet 120 may be welded to Rail post 103 such that it may securely hold wire, rope, chain or other tension bearing flexible material. Primary top rail eyelet 106 may be welded to Rail post 103 such that Primary top rail eyelet opening 108 may securely hold wire, rope, chain or other tension bearing flexible material. Similarly, Secondary top rail eyelets 110 may be welded to Rail post 103 such that it may securely hold wire, rope, chain or other tension bearing flexible material. Primary top rail eyelet 106 or Primary top rail eyelet opening 108 may be selected based on the configuration of other posts and the intended path of associated railings. Clasp base lower extent 166 and Clasp hinge arm lower extent 168 may be situated such that they are separated from Deck 303 by at least 1 inch. Clasp base lower extent 166 and Clasp hinge arm lower extent 168 may be situated such that they are separated from Deck 303 by approximately 2 inches.

Figure 5:
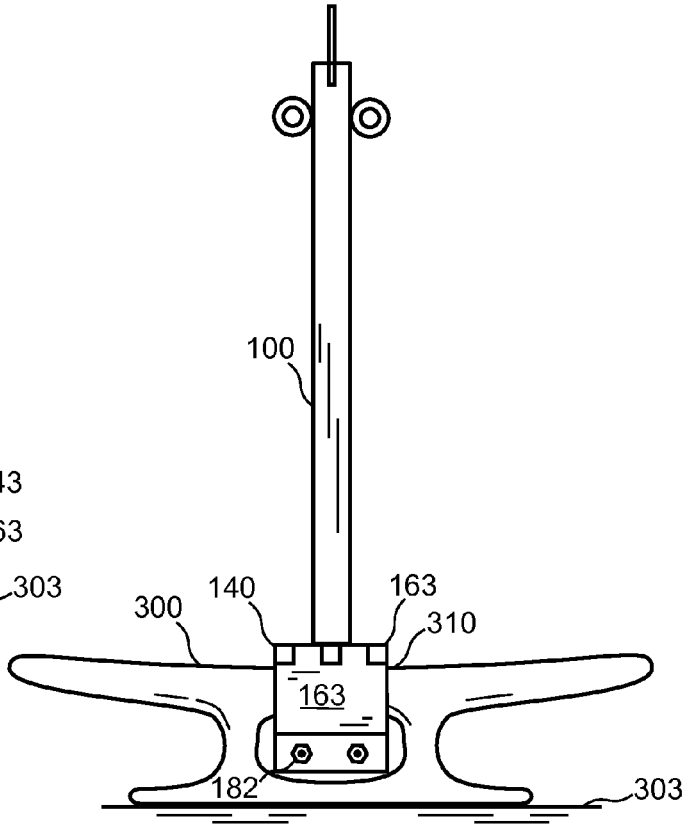
FIG. 5 shows a rear view of a kevel post assembly attached to a kevel.

Referring now to FIG. 4 and FIG. 5 of the drawings, Kevel post assembly 100 may be situated on and clamped to Kevel 300 by rotating Clasp hinge arm 163 around Kevel clasp hinge 143 such that Kevel clasp 140 surrounds the upper portion of Kevel 300 with Clasp base 160 and Clasp hinge arm 163 enclosing the upper central portion of Kevel 300. In such a configuration Nuts 182 may be tightened on Bolts 180 to draw Kevel clasp 140 inward securely locking Kevel post assembly 100 into place and into a fixed position on Kevel 300. After such tightening, Kevel post assembly 100 and Primary top rail eyelet opening 108 would be in a fixed position relative to Deck 303. In that configuration, Kevel top surface 310 would bear the majority of the weight of Kevel post assembly 100 and support downward forces applied through Kevel post assembly 100. Rail post 103 ends at Kevel clasp 140 at a position adjacent to Kevel top surface 310. Kevel top surface 310 may be at least 3 inches above Deck 303 and in a related embodiment, Kevel top surface 310 may be at least 5 inches above Deck 303.

Figure 6:
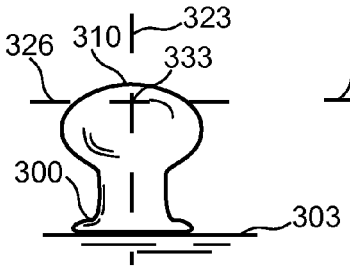
FIG. 6 shows a kevel.
Figure 7:
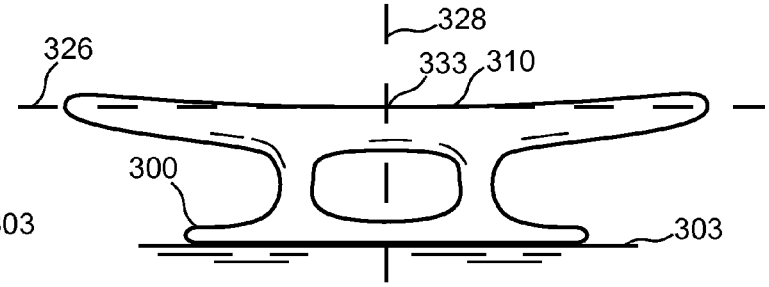
FIG. 7 shows a kevel.

Referring now to FIG. 6 and FIG. 7 of the drawings, Kevel 300 is situated on Deck 303 such that Kevel top center point 333 is situated at the convergence of Kevel longitudinal axis 323, Kevel top base level 326, and Kevel cross axis 328. Kevel longitudinal axis 323 divides Kevel 300 evenly along the length of Kevel 300. Kevel top base level 326 represents the height of Kevel 300 at the center of Kevel 300. Kevel cross axis 328 divides Kevel 300 evenly along the width of Kevel 300. Each of Kevel longitudinal axis 323, Kevel top base level 326, and Kevel cross axis 328 are perpendicular to one another. As may be seen through the combination of FIG. 4, FIG. 5, FIG. 6, and FIG. 7, the weight of Kevel post assembly 100 is predominantly supported by Kevel 300 through the contact between Kevel post assembly 100 and Kevel 300 at Kevel top base level 326. Kevel top center point 333 may be situated at a height of about 8.5 inches above Deck 303.

The weight of Kevel post assembly 100 may, for example, be predominantly supported by loadbearing contact with Kevel 300 at a height of greater than 2 inches above deck level. In a related example, the weight of Kevel post assembly 100 may, for example, be predominantly supported by loadbearing contact with Kevel 300 at a height of greater than 4 inches above deck level. In a further related example, the weight of Kevel post assembly 100 may, for example, be predominantly supported by loadbearing contact with Kevel 300 at a height of greater than 6 inches above deck level. In a further related example, the weight of Kevel post assembly 100 may, for example, be predominantly supported by loadbearing contact with Kevel 300 at a height of greater than 7 inches above deck level.

In several embodiments, Deck 303 and Kevel post assembly 100 are neither joined directly nor in direct contact with one another. In related but separate embodiments, the distance between Deck 303 and Kevel post assembly 100 may be greater than 1 inch, greater than 2 inches or greater than 3 inches. As shown in FIG. 2 and FIG. 4, Rail post 103 may be arranged at an angle from vertical. Various embodiments may have one or more of the following features: a Rail post 103 which departs from a vertical orientation by an angle of greater than 5°, a Rail post 103 which departs from a vertical orientation by an angle of approximately 15°, a Rail post 103 which departs from a vertical orientation by an angle of less than 20°, and a Rail post 103 which departs from a vertical orientation by an angle of less than 30°. Rail post 103 may for example depart from a vertical orientation by an angle of 15°. In an alternate embodiment, Rail post 103 may have a vertical orientation. Rail post 103 may depart from vertical such that Rail post 103 leans from Kevel 300 toward a precipice which may be the edge of a nautical vessel.

Kevel 300 and Kevel post assembly 100 may be positioned such that, the center of gravity of Kevel 300 may be located above a first deck location and the center of gravity of Kevel post assembly 100 may be located above a second deck location such that the first deck location and the second deck location are within 2 feet of one another. Similarly, the first deck location may be within one foot of the second deck location.

Figure 8:
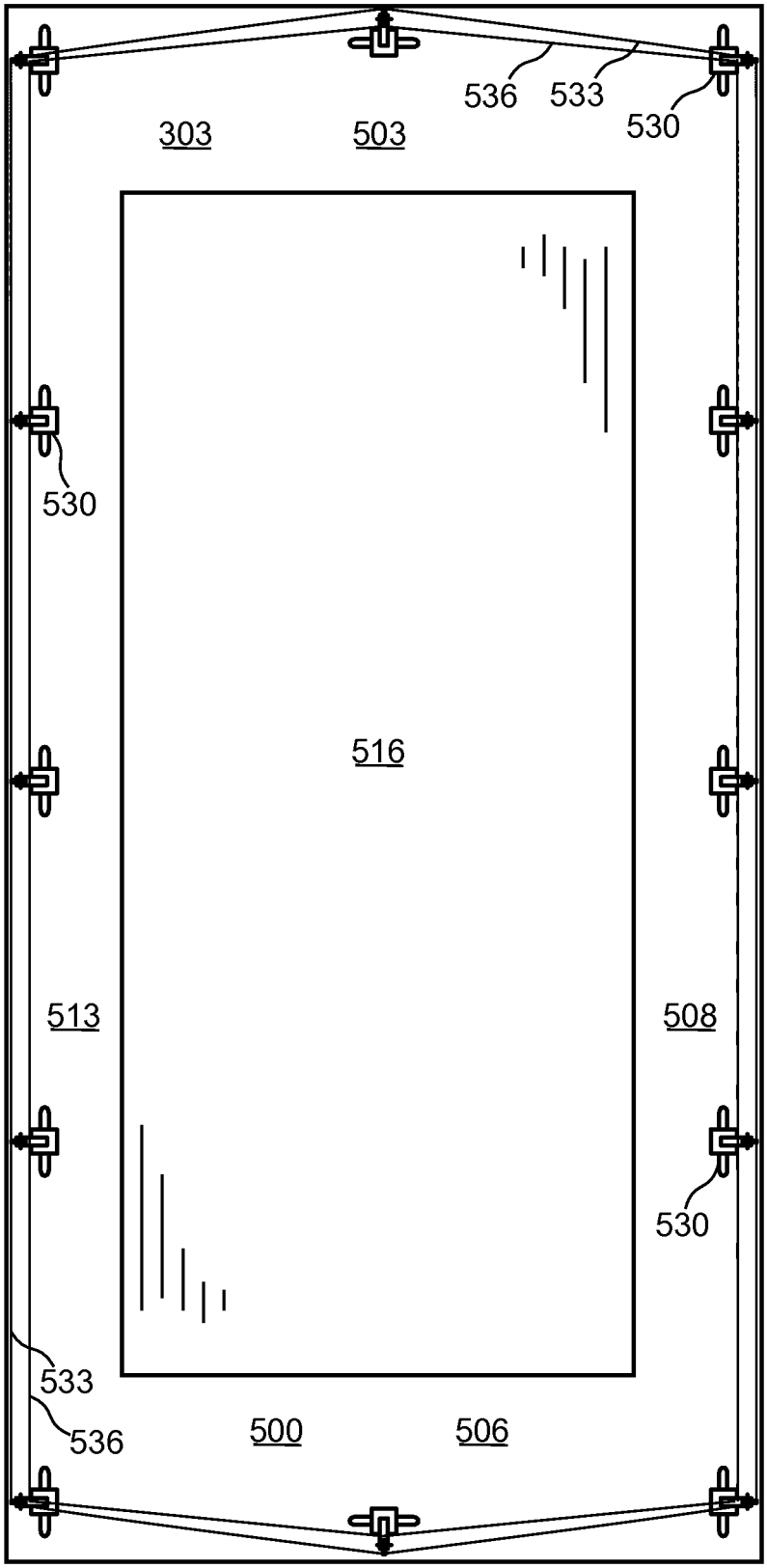
FIG. 8 shows a top view of a barge.

Referring now to FIG. 8 of the drawings, Barge 500 may incorporate Post assemblies 100 (not individually shown) on Kevels 300 (not individually shown). Post assembly on a kevel 530 as shown in FIG. 8 includes a Kevel post assembly 100 situated on a Kevel 300. As shown in FIG. 8 a Post assembly on a kevel 530 is shown at each of the locations where a Kevel 300 is located on Barge 500. Barge 500 may be set up in this configuration or a large number of additional configurations depending on the fall protection needs for either the general situation of Barge 500 or the particular situation of Barge 500 at a point in time. Supplemental post assemblies that are not attached to kevels may be added to the railing system. The number of Post assemblies on kevels 530 on a Barge 500 would in most circumstances be at least two and not greater than the number of Kevels 300 on Barge 500. However, in circumstances in which more than one Barge 500 is adjacent to one another an individual Post assembly on a kevel 530 may be used on one of the Barges 500. Barge 500 has a Deck 303 which is the primary walking surface for Barge 500. Barge 500 further has a Bow 503 a Stern 506, a Starboard side 508, a Port Side 513, and a Cargo Area 516. One or more of Top rail wire rope 533 and one or more of Middle rail wire rope 536 may be run through the eyelet openings of Post assemblies 100 (not individually shown) which are part of Post assemblies on kevels 530. Top rail wire rope 533 and Middle rail wire rope 536 may be drawn to be taut such that they positioned to serve as a fall protection top rail and middle rail. Referring back to FIG. 1, FIG. 2, FIG. 3, FIG. 4, and FIG. 5 of the drawings, Primary top rail eyelet 106 and Secondary top rail eyelets 110 may be used to guide, secure and hold taut Top rail wire rope 533 with the selection between Primary top rail eyelet 106 and Secondary top rail eyelets 110 depending on the position of Post assembly on a kevel 530 and the desired path of the Top rail wire rope 533. Middle rail eyelet 120 may be used to guide, secure and hold taut Middle rail wire rope 536. Middle rail eyelet 120 may be attached to Rail post 103 at Middle rail eyelet connection point 113. Together, Top rail wire rope 533, Middle rail wire rope 536, and Post assemblies on kevels 530 form a fall protection barrier in the form of posts and rails to protect workers and any other occupants on Deck 303 from the risk of falling off of Deck 303.

The point where Kevel post assembly 100 contacts Top rail wire rope 533 may be less than 42 inches from Kevel top center point 333. Further, the point where Kevel post assembly 100 contacts Middle rail wire rope 536 may be less than 19 inches from Kevel top center point 333. Top rail wire rope 533 and Middle rail wire rope 536 may be located within one foot of Kevel longitudinal axis 323 and may alternatively be located within 2 feet of Kevel longitudinal axis 323.

Example 2

In one embodiment, a barge having kevels and one or more precipices that pose a significant fall hazard is outfitted with post assemblies as described in the preceding example such that the post assemblies are positioned on kevels and adjacent to the one or more precipices presenting the fall hazard. After the post assemblies are secured into place on the kevels wire rope or other suitable barricading materials are secured into place between the post assemblies such that a fall protection barricade is located along and adjacent to the one or more precipices. The resulting barricade may be consistent with the configurations depicted in one or more of FIGS. 1, 2, 3, 4, 5, and 8 or may take on any number of suitable variations. Further, similar practices may be employed utilizing the embodiments described in the following examples.

Example 3

Figure 9:
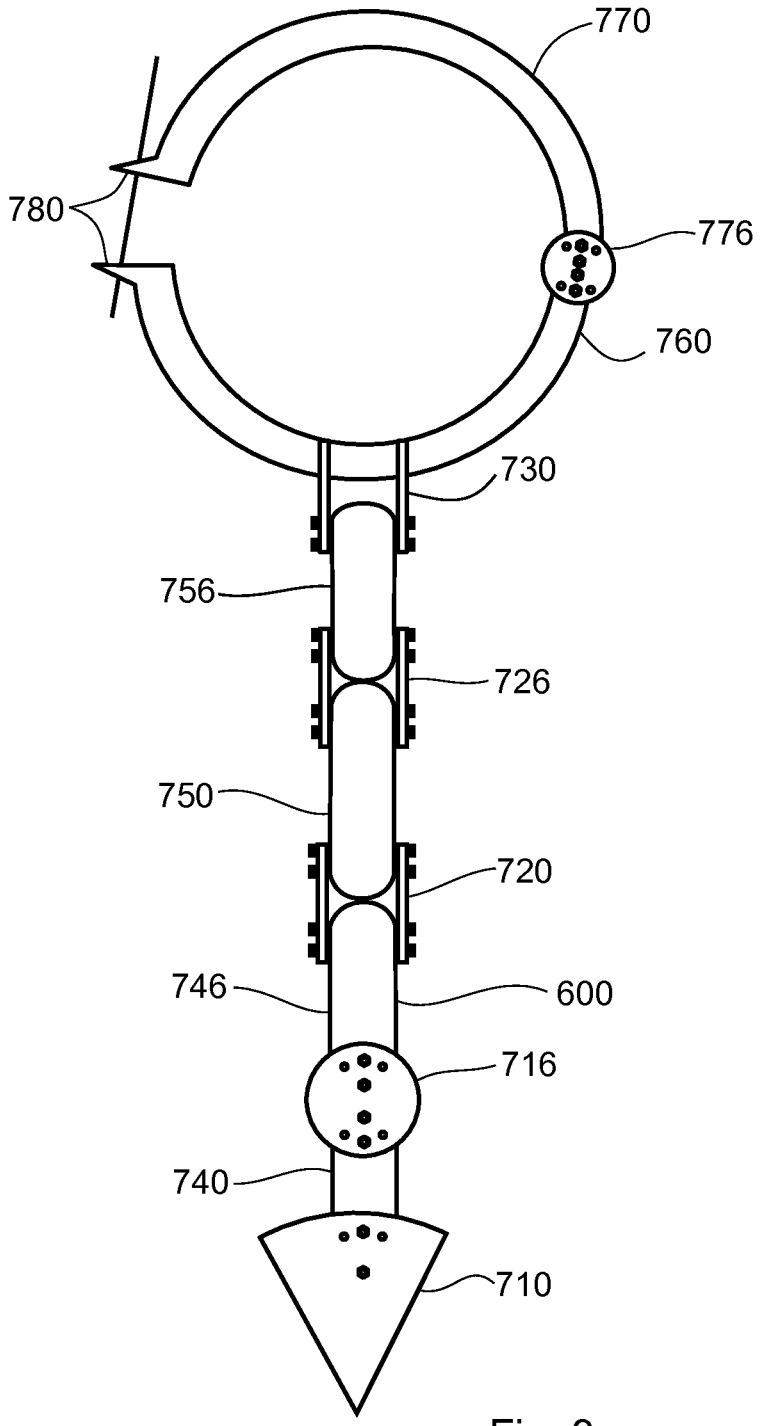
FIG. 9 shows a top view of a portion of a timberhead post assembly.
Figure 10:
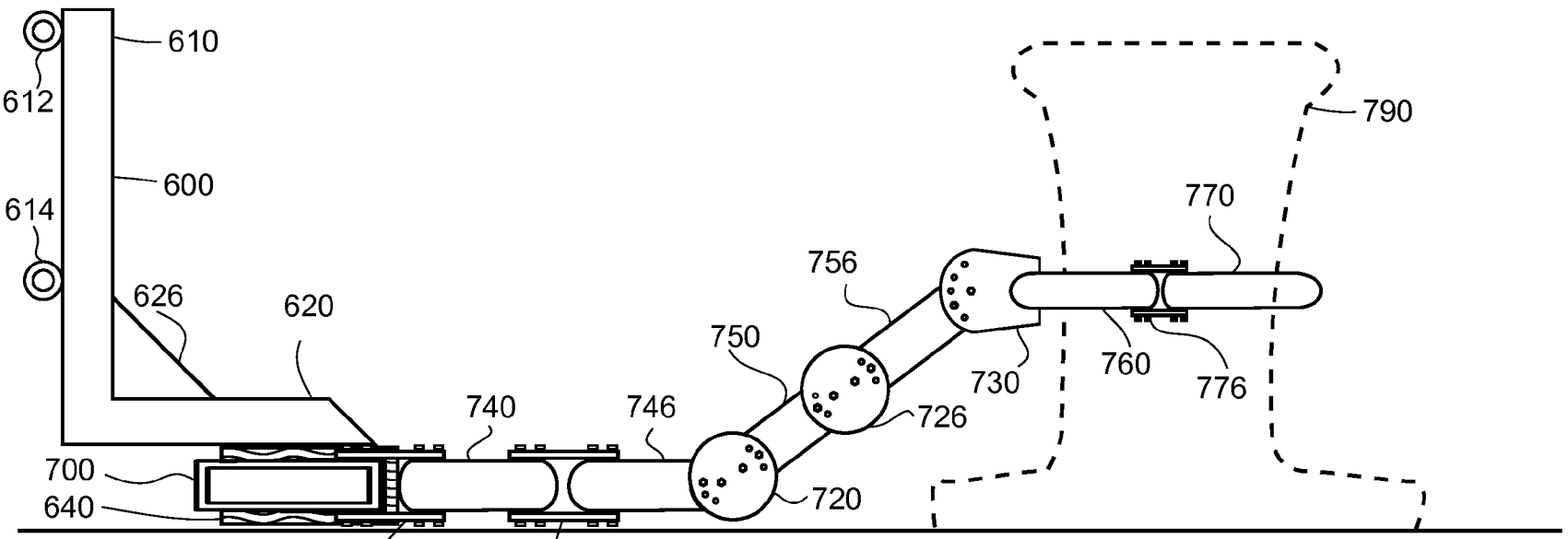
FIG. 10 shows a side view of a timberhead post assembly.
Figure 11:
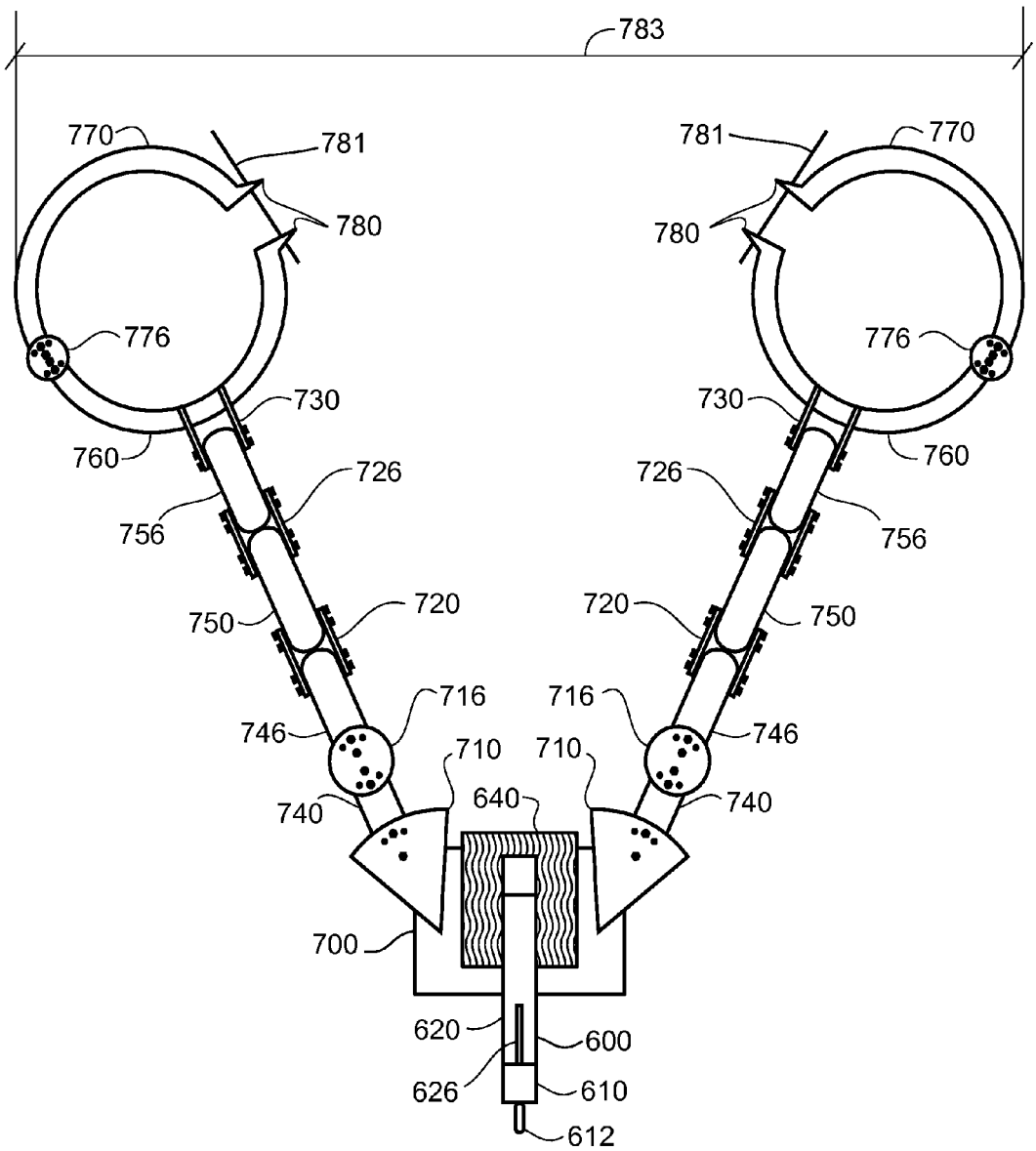
FIG. 11 shows a top view of a timberhead post assembly.

Referring now to FIGS. 9, 10, and 11 of the drawings, Timberhead post assembly 600 may for example have the following components: Timberhead post 610, Post arm 620, Gusset 626, Arm attachment frame 640, Base 700, First timberhead bracket 710, Second timberhead bracket 716, Third timberhead bracket 720, Fourth timberhead bracket 726, Fifth timberhead bracket 730, First timberhead arm 740, Second timberhead arm 746, Third timberhead arm 750, Fourth timberhead arm 756, Primary timberhead collar 760, Secondary timberhead collar 770, Timberhead collar connecting bracket 776, Collar connection points 780, and Threaded rod 781 and Timberhead post assembly 600 may securely attach to a Timberhead 790. Timberhead post assembly 600 is configured for placement on Deck 303 of Barge 800 such that railings may be placed as fall protection for Barge 800. Timberhead post 610 may be configured to rise vertically or substantially vertically above Post arm 620 such that Timberhead post 610 serves as the post of a railing system. Gusset 626 may add stability between Timberhead post 610 and Post arm 620. The connections between Timberhead post 610, Post arm 620, Gusset 626, and Arm attachment frame 640 may be welded connections. Arm attachment frame 640 may be removably connected to Base 700 such that Arm attachment frame 640 may slide over Base 700 and snugly fit around Base 700. Arm attachment frame 640 may be secured in place relative to Base 700 by threaded bolts that go through Arm attachment frame 640 and tighten against Base 700. First timberhead bracket 710 may be bolted or welded to Base 700 and may be bolted or welded to First timberhead arm 740. Each of the connections between brackets and arms that follow are described merely as connections with the understanding that such connections may be made by bolting, by welding, or by other connection means. It should be understood that bolted connections between the arms and the brackets allow for greater flexibility of Timberhead post assembly 600 such that Timberhead post assembly 600 may be used on different barges that have different sizes and configurations of timberheads. Accordingly, various alternate embodiments of Timberhead post assembly 600 could be made with fewer arms and fewer brackets and may have more welded or non-adjustable connections when the timberheads to which Timberhead post assembly 600 is being applied have little or no variation in their configuration. Each of First timberhead bracket 710, Second timberhead bracket 716, Third timberhead bracket 720, Fourth timberhead bracket 726, and Fifth timberhead bracket 730 may be constructed of a pair of similar steel plates or some other resilient material suited to the environment in which Timberhead post assembly 600 will be placed in service. In the case where the brackets have drilled or cut holes for the placement of bolts, typically there will be a series of drilled or cut holes allowing the bolting of arms in place on the bracket in multiple positions. The hole placements on the various brackets are designed to position the Primary timberhead collar 760 and the Secondary timberhead collar 770 at a height and horizontal separation from a corresponding set of Primary timberhead collar 760 and Secondary timberhead collar 770 allowing the Primary timberhead collars 760 and the Secondary timberhead collars 770 to grasp a pair of timberheads securely and at a height on the timberheads that allows for most of the typical activities associated with timberheads to go on unimpeded by Timberhead post assembly 600. Because Primary timberhead collar 760 and Secondary timberhead collar 770 are elevated above deck level they can be installed when mooring lines are tied to Timberhead 790. As depicted in FIG. 11, Primary timberhead collar 760 and Secondary timberhead collar 770 are configured to grasp timberheads having diameters from 8 inches to 14 inches and the Timberhead collar pair width 783 may be configured to be as small as 14 inches or up to 40 inches. As depicted in the figures, First timberhead arm 740, Second timberhead arm 746, Third timberhead arm 750, and Fourth timberhead arm 756, are secured in place by First timberhead bracket 710, Second timberhead bracket 716, Third timberhead bracket 720, Fourth timberhead bracket 726, and Fifth timberhead bracket 730. Fifth timberhead bracket 730 may be welded directly to Primary timberhead collar 760. Primary timberhead collar 760 and Secondary timberhead collar 770 are configured to surround and clasp Timberhead 790. Timberhead collar connecting bracket 776 may be configured to adjust to multiple positions and Threaded rod 781 may be used to tighten Primary timberhead collar 760 and Secondary timberhead collar 770 around Timberhead 790. Primary timberhead collar 760 and Secondary timberhead collar 770 may be configured to grasp or hold cylindrical objects having diameters between 8 and 12 inches and the timberhead arms may be configured to grasp timberheads with centers that are two feet apart. Primary timberhead collar 760 and Secondary timberhead collar 770 may be configured to grasp timberheads with centers that are between one and three feet apart. Bolts may be threaded along Threaded rod 781 tightening them against Collar connection points 780 to tightly secure Primary timberhead collar 760 and Secondary timberhead collar 770 around Timberhead 790. Primary timberhead collar 760 and Secondary timberhead collar 770 may be constructed of bent pipe. Arm attachment frame 640 and Base 700 may be constructed of bent or welded plate metal, such as, for example, steel plate. The timberhead arms may be constructed of pipe or of a metal square tubing. Post arm 620 and Timberhead post 610 may also be constructed of metal square tubing. The various components described herein may be constructed of Aluminum and that aluminum may take the form of T5-5061 or T6-6061 aluminum. Bolts described herein may be at or between SAE J429 Grade 5 and Grade 8. Plate metal used herein may be ¾ inch or less and may be ½ inch plate metal. Tubing used herein may be 1 ½ inch or 2 inch square tubing and may have a wall thickness of ⅛ inch. In an alternate embodiment, 2" pipe may be utilized. In such embodiments, the iron pipe may have a ⅛ inch wall thickness and may be A105 steel.

Although timberheads commonly appear in pairs and in many cases a pair of timberheads is constructed from a single piece of iron, the term "timberhead" as used herein refers to only a single vertical projection above a deck such that a Timberhead post assembly 600 as depicted in FIG. 11 would attach to a pair of timberheads.

In an alternate embodiment, Timberhead post assembly 600 could be attached to a single Timberhead 790. In such cases, Timberhead post assembly 600 may have an additional component stabilizing Timberhead post assembly 600 against horizontal motion or may be positioned between two other mooring structure rail post assemblies with taut wire rope or other stable railing potentially contributing to the horizontal stability of Timberhead post assembly 600.

Example 4

Figure 12:
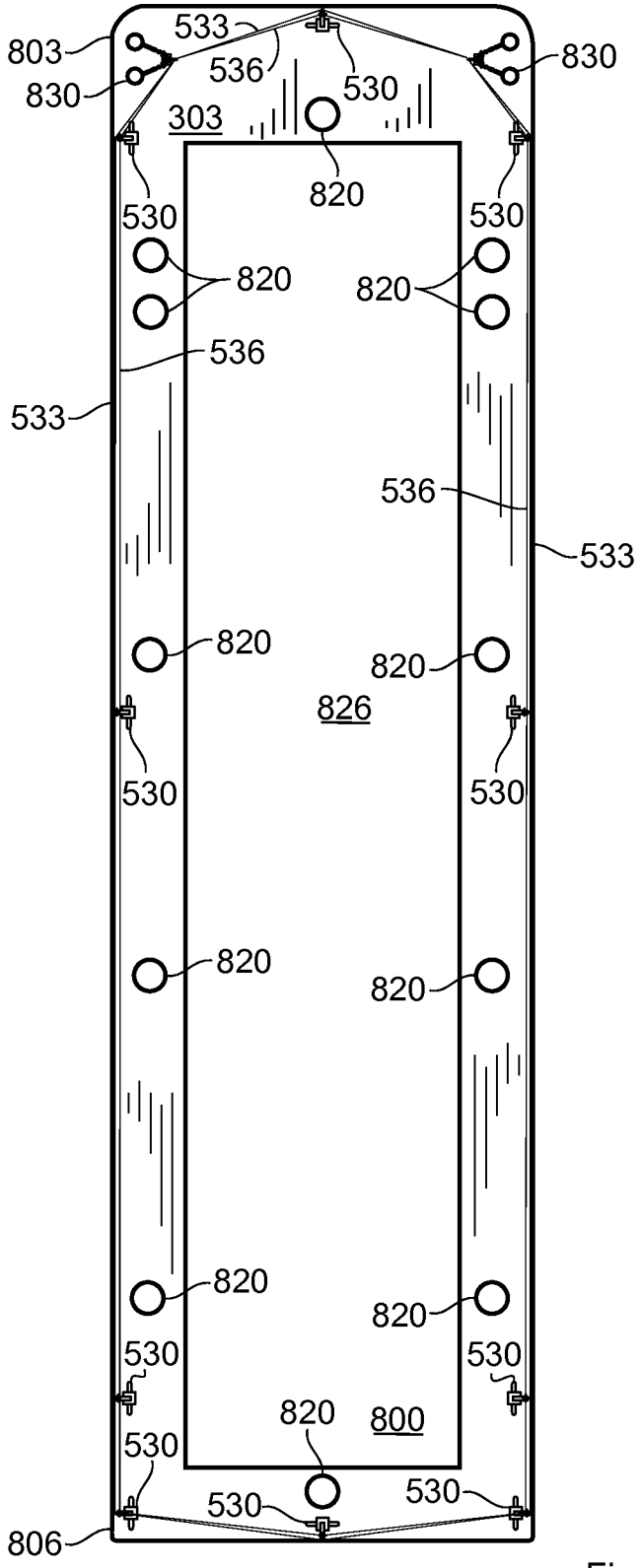
FIG. 12 shows a top view of a barge.
Figure 13:
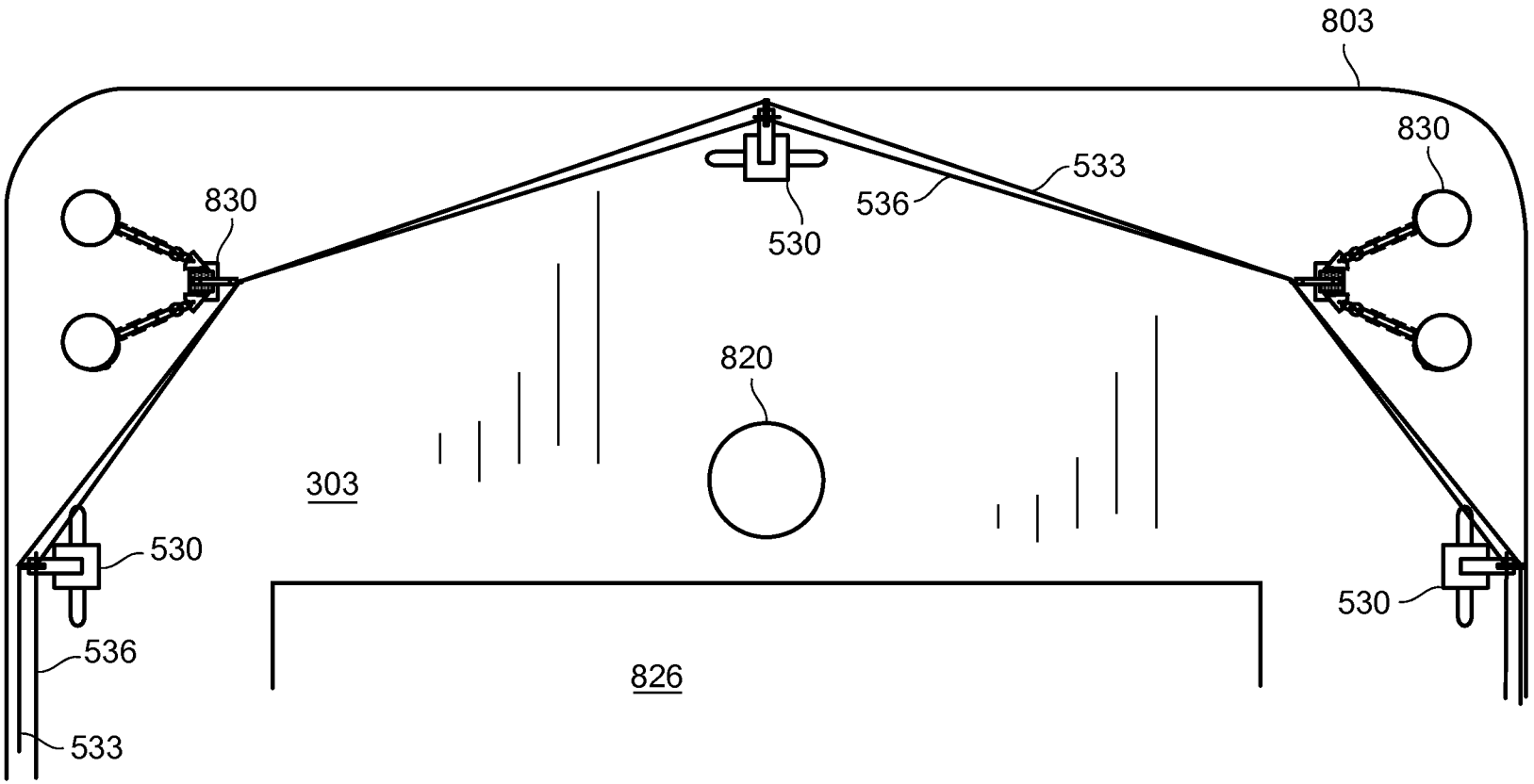
FIG. 13 shows a partial top view of a barge focusing on the bow.

Referring now to FIGS. 12 and 13 of the drawings, Barge 800 may incorporate Post assemblies on kevels 530, Timberhead post assembly on timberheads 830, Deck 303, Bow 803, Stern 806, Top rail wire rope 533, Middle rail wire rope 536, Port holes 820, and Cargo area 826. Post assemblies 100 and Kevels 300 are not individually shown but are labeled collectively as Post assembly on a kevel 530. Similarly, Timberhead post assembly on timberheads 830 includes Timberhead post assembly 600 situated on Timberheads 890. Post assembly on a kevel 530 is shown at each of the locations where a Kevel 300 is located on Barge 800 and similarly Timberhead post assembly 600 may be situated at each location where a pair of Timberheads 890 are located. Barge 800 may be set up in this configuration or a large number of additional configurations depending on the fall protection needs for either the general purpose needs of Barge 500 or the particular situation of Barge 500 at a point in time. The combination of Post assemblies on kevels 530 and the Timberhead post assembly on timberheads 830 allows the area within Top rail wire rope 533 and Middle rail wire rope 536 on Barge 800 to be expanded as compared to the area within Top rail wire rope 533 and Middle rail wire rope 536 when only Post assemblies on kevels 530 are used. Further the use of Timberhead post assembly on timberheads 830 allows for better access to Timberheads 890 from the area within Top rail wire rope 533 and Middle rail wire rope 536. As described above, the configuration of Timberhead post assembly 600 may be varied by adjusting the angles at which components, such as timberhead arms are connected to the timberhead brackets, and by adjusting the number of timberhead arms used in the setup of Timberhead post assembly 600. For example, the number of timberhead arms could be reduced to one, two, three, or four timberhead arms per timberhead. In such case, the Timberhead post 610 would generally, but not necessarily, be situated closer to Timberheads 890. When a barge such as Barge 800 is configured as depicted in FIGS. 12 and 13 the usable area of Deck 303 contained within both Top rail wire rope 533 and Middle rail wire rope 536 may be greater than 60% of the total area of Deck 303. Further, when a barge such as Barge 800 is configured as depicted in FIGS. 12 and 13 the usable area of Deck 303 contained within both Top rail wire rope 533 and Middle rail wire rope 536 may be greater than 80% of the total area of Deck 303. Supplemental post assemblies that are not attached to either kevels or timberheads may be added to the railing system. As shown in FIGS. 12 and 13, The Top rail wire rope 533 and Middle rail wire rope 536 of Barge 800 may run through Top rail eyelet 612 and Middle rail eyelet 614 respectively. Barge 800 may have a Bow 803, a Stern 806, Port holes 820, and a Cargo area 826 which may, for example, be configured to carry a liquid cargo.

As used herein, the phrase "Nautical mooring structure" indicates a structure located on the deck of a nautical vessel suitable for mooring the nautical vessel with mooring lines. The phrase "Nautical mooring structure" encompasses Timberheads 790, Kevels 300, and a variety of other similarly functioning components consistent with the above description. As used herein, the phrase "Mooring structure rail post assembly" indicates a structure having a post located within 5 feet of a Nautical mooring structure that is both secured to the Nautical mooring structure and rises at least 4 foot 3 inches above the deck of the nautical vessel. The phrase "Mooring structure rail post assembly" encompasses Timberhead Post assemblies 600, Kevel post assemblies 100, and a variety of other similarly functioning embodiments. The number of Mooring structure rail post assemblies on a barge would in most circumstances be at least two and not greater than the combined number of Kevels 300 and Timberheads 790 on a barge. However, in circumstances in which more than one barge is adjacent to one another or docked, an individual Mooring structure rail post assembly may be used on one of the Barges. Barge 500 and Barge 800 each have a Deck 303 which is the primary walking surface for the barges. One or more of Top rail wire rope 533 and one or more of Middle rail wire rope 536 may be run through the eyelet openings of Post assemblies on kevels 530 and Timberhead Post assemblies 600. Top rail wire rope 533 and Middle rail wire rope 536 may be drawn to be taut such that they positioned to serve as a fall protection top rail and middle rail. Referring back to FIGS. 1-5, 10, and 11 of the drawings, Primary top rail eyelet 106, Secondary top rail eyelet 110, and Top rail eyelet 612, may be used to guide, secure and hold taut Top rail wire rope 533 with the selection between Primary top rail eyelet 106 and Secondary top rail eyelets 110 depending on the position of Post assembly on a kevel 530 and the desired path of the Top rail wire rope 533. Middle rail eyelet 120, and Middle rail eyelet 614 may be used to guide, secure and hold taut Middle rail wire rope 536. Together, Top rail wire rope 533, Middle rail wire rope 536, Post assemblies on kevels 530 and Timberhead Post assemblies 600 form a fall protection barrier in the form of posts and rails to protect workers and any other occupants on Deck 303 from falling off of Deck 303.

Top rail wire rope 533 and Middle rail wire rope 536 are examples of materials that could be used between Mooring structure rail post assemblies. In alternate embodiments, various flexible materials with significant tensile strength may be used in place of the wire rope. Examples of replacement materials might be rope such as hemp rope, chains and various forms of wires or cables. In certain other embodiments, rigid elements could be used to span the Mooring structure rail post assemblies such as lumber or elongate rigid metal elements. Further, combinations of rigid and non-rigid materials may be used. Because Kevels 300 and Timberheads 790 would generally be considered a part of Barge 500 or Barge 800 the connection between the barges and either Kevel post assembly 100 or Timberhead post assembly 600 may be characterized as a weldless connection.

Together, Top rail wire rope 533, Middle rail wire rope 536, and Mooring structure rail post assemblies may be configured to create a fall protection system that has the following features. Top rail wire rope 533 and Middle rail wire rope 536 may be constructed of wire rope that is at least one-quarter inch in diameter. Top rail wire rope 533, may be flagged at intervals of 6 feet or less with high-visibility material. Further, manila, plastic, or synthetic rope may be used in place of Top rail wire rope 533 or Middle rail wire rope 536. The top edge height of Top rail wire rope 533, or any equivalent railing may be 42 inches plus or minus 3 inches above the walking, working, or deck level. Middle rail wire rope 536 may be installed at a height midway between the top edge of the guardrail system and the walking, working, or deck level. The railing system may be constructed such that there are no openings in the railing system more than 19 inches. The railing system may be capable of withstanding a force of at least 200 pounds applied within 2 inches of the top edge in any outward or downward direction. Further, when the 200 pound test is applied in a downward direction, Top rail wire rope 533 may be configured such that it does not deflect to a height less than 39 inches above the walking, working, or deck level. Middle rail wire rope 536 may be used in conjunction with or replaced by screens, mesh, intermediate vertical members, solid panels, and equivalent structural members and in certain embodiments those structures are capable of withstanding a force of at least 150 pounds applied in any downward or outward direction at any point along the Middle rail wire rope 536 or equivalent member.

Any number of Mooring structure rail post assemblies may be utilized in conjunction with ropes, wire ropes or other materials to create either fully enclosed areas or partially enclosed areas. In many embodiments, Mooring structure rail post assemblies are used to barricade a particular area from a precipice and the barricade terminates at one or more of Mooring structure rail post assemblies.

Kevel post assembly 100 and Timberhead post assembly 600 may be constructed from one or more of iron, WCB iron, steel, aluminum, stainless steel, and various alloys suitable for the marine environment in which Kevel post assembly 100 and Timberhead post assembly 600 are to be utilized. Further, Kevel post assembly 100 and Timberhead post assembly 600 may be galvanized, powder coated, painted or otherwise treated to prolong the useful life of Kevel post assembly 100 and Timberhead post assembly 600.

As that term is used herein "flexible tension device" includes for example chains, rope, wire rope and other similar items that can be similarly tensioned and are capable of being looped.

Railing structures described herein may, for example, comprise a deck; a first kevel located on the deck, the first kevel having a first kevel center of gravity; a first deck location on the deck directly below the first kevel center of gravity; a first post structure located above the deck having a first post center of gravity; a second deck location on the deck directly below the first post center of gravity; a weldless mechanical connection joining the first kevel to the first post structure; and a set of rails extending horizontally from the first post structure; wherein the first deck location is within two feet of the second deck location. In a related example, the set of rails may comprise a wire rope. In a further related example, the set of rails may comprise a flexible tension device. In a further related example, the first kevel has a first kevel top and the first kevel top may bear the majority of downward force exerted by the first post structure. In a still further related example, the first post structure is not directly connected to the deck.

Fall protection structures described herein may, for example, comprise a nautical vessel; a precipice on the nautical vessel; a first kevel adjacent to the precipice; a second kevel adjacent to the precipice; a first post structure connected to the first kevel; a second post structure connected to the second kevel; a top railing connecting the first post structure to the second post structure; and a middle railing connecting the first post structure to the second post structure; wherein the top railing and the middle railing limit access to the precipice. In a related example, the top railing and the middle railing may be located between and above the first kevel and the second kevel. In a further related example, the nautical vessel may be a barge. In a further related example, the first post structure may bolt onto the first kevel. In a still further related example, the top railing and the middle railing may enclose a portion of the nautical vessel. In a still further related example the first post structure comprises a first mechanical clamp and the second post structure comprises a second mechanical clamp.

Railing structures described herein may, for example, comprise a deck; a kevel positioned on the deck; a timberhead positioned on the deck; a first post mechanically attached to the kevel and rising above the deck; a first post middle attachment point on the first post; a first post upper attachment point on the first post; a second post mechanically attached to the timberhead and rising above the deck; a second post middle attachment point on the second post; a second post upper attachment point on the second post; a first rail connecting the first post middle attachment point and the second post middle attachment point; and a second rail connecting the first post upper attachment point and the second post upper attachment point. In a related example, the first rail and the second rail may comprise wire rope. In a further related example, the first rail and the second rail may comprise flexible tension devices. In a related example, the first post bolts onto the kevel. In a further related example, the second post is secured to the timberhead by way of a collar surrounding the timberhead. In a further related example, the collar is a mechanical clamp. In a further related example, the deck is situated on a barge. In a further related example, the first rail and the second rail enclose a portion of the deck.

Railing assemblies described herein may, for example, comprise a deck; a first timberhead; a second timberhead; a first post supported by the deck and rising above the deck; a first appendage attached to the first post and mechanically secured to the first timberhead; a second appendage attached to the first post and mechanically secured to the second timberhead; a first post middle attachment point on the first post; and a first post upper attachment point on the first post. In a related example, the first appendage comprises at least one adjustable mechanical connection. In a further related example, the first appendage comprises at least one adjustable mechanical connection and the second appendage comprises at least one adjustable mechanical connection. In a further related example, a point at which the first post is mechanically secured to the first timberhead is sufficiently above the deck to allow a mooring line to be attached to the first timberhead between the deck and the point. In a further related example, the first appendage and the second appendage are adjustable such that a distance between the first appendage and the second appendage may be changed. In a further related example, the first timberhead has a first timberhead center; the second timberhead has a second timberhead center; and the first timberhead center is between one and three feet apart from the second timberhead center.

The above-described embodiments have a number of independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

I claim:

1. A railing structure comprising:

a. a deck;

b. a kevel positioned on the deck;

c. a timberhead positioned on the deck;

d. a first post mechanically attached to the kevel and rising above the deck;

e. a first post middle attachment point on the first post;

f. a first post upper attachment point on the first post;

g. a second post mechanically attached to the timberhead and rising above the deck;

h. a second post middle attachment point on the second post;

i. a second post upper attachment point on the second post;

j. a first rail connecting the first post middle attachment point and the second post middle attachment point; and k. a second rail connecting the first post upper attachment point and the second post upper attachment point;

l. wherein the first rail and the second rail comprise flexible tension devices.

2. The railing structure of claim 1 wherein the flexible tension devices comprise wire rope.

3. The railing structure of claim 1 wherein the first post bolts onto the kevel.

4. The railing structure of claim 1 wherein the second post is secured to the timberhead by way of a collar surrounding the timberhead.

5. The railing structure of claim 4 wherein the collar is a mechanical clamp.

6. The railing structure of claim 1 wherein the deck is situated on a barge.

7. The railing structure of claim 1 wherein the first rail and the second rail enclose a portion of the deck.

8. A railing assembly comprising:

a. a deck;

b. a first timberhead;

c. a second timberhead;

d. a first post supported by the deck and rising above the deck;

e. a first appendage attached to the first post and mechanically secured to the first timberhead;

f. a second appendage attached to the first post and mechanically secured to the second timberhead;

g. a first post middle attachment point on the first post; and h. a first post upper attachment point on the first post;

i. wherein the first appendage comprises at least one adjustable mechanical connection.

9. The railing assembly of claim 8 wherein the first appendage comprises at least one adjustable mechanical connection and the second appendage comprises at least one adjustable mechanical connection.

10. The railing assembly of claim 8 wherein a point at which the first post is mechanically secured to the first timberhead is sufficiently above the deck to allow a mooring line to be attached to the first timberhead between the deck and the point.

11. The railing assembly of claim 8 wherein the first appendage and the second appendage are adjustable such that a distance between the first appendage and the second appendage may be changed.

12. The railing assembly of claim 8 wherein a. the first timberhead has a first timberhead center;

b. the second timberhead has a second timberhead center; and c. the first timberhead center is between one and three feet apart from the second timberhead center.

13. A railing assembly comprising:

a. a deck;

b. a first timberhead;

c. a second timberhead;

d. a first post supported by the deck and rising above the deck;

e. a first appendage attached to the first post and mechanically secured to the first timberhead;

f. a second appendage attached to the first post and mechanically secured to the second timberhead;

g. a first post middle attachment point on the first post; and h. a first post upper attachment point on the first post;

i. wherein a point at which the first post is mechanically secured to the first timberhead is sufficiently above the deck to allow a mooring line to be attached to the first timberhead between the deck and the point.

* * * * *